US010941554B2

(12) United States Patent
Ge

(10) Patent No.: US 10,941,554 B2
(45) Date of Patent: Mar. 9, 2021

(54) NOZZLE ASSEMBLY

(71) Applicant: Shanghai Kohler Electronics, Ltd., Shanghai (CN)

(72) Inventor: Xiaobing Ge, Shanghai (CN)

(73) Assignee: SHANGHAI KOHLER ELECTRONICS, LTD., Shanghai (CN)

( * ) Notice: Subject to any disclaimer, the term of this patent is extended or adjusted under 35 U.S.C. 154(b) by 0 days.

(21) Appl. No.: 16/520,850

(22) Filed: Jul. 24, 2019

(65) Prior Publication Data

US 2020/0032498 A1 Jan. 30, 2020

(30) Foreign Application Priority Data

Jul. 27, 2018 (CN) ..... 201810848333.8
Jul. 27, 2018 (CN) ..... 201821219661.3

(51) Int. Cl.
*E03D 9/08* (2006.01)
*B05B 1/14* (2006.01)
*B05B 1/30* (2006.01)

(52) U.S. Cl.
CPC ..... *E03D 9/08* (2013.01); *B05B 1/14* (2013.01); *B05B 1/30* (2013.01)

(58) Field of Classification Search
CPC ..... E03C 9/08
USPC ..... 4/420.1–420.5
See application file for complete search history.

(56) References Cited

U.S. PATENT DOCUMENTS

| | | | | |
|---|---|---|---|---|
| 8,495,770 | B2 * | 7/2013 | Koga | B05B 15/74 4/420.4 |
| 9,578,817 | B2 * | 2/2017 | Dunn | B05B 3/0422 |
| 10,427,179 | B2 * | 10/2019 | Posselius | B05B 12/1418 |
| 10,494,804 | B2 * | 12/2019 | Tsuruta | B05B 7/04 |
| 2006/0060666 | A1 * | 3/2006 | Parod | A01G 25/09 239/200 |
| 2006/0207006 | A1 * | 9/2006 | Koga | E03D 9/08 4/420.4 |
| 2007/0143914 | A1 * | 6/2007 | Shirai | D06F 39/04 4/420.2 |
| 2017/0275865 | A1 * | 9/2017 | Hashimoto | E03D 9/08 |
| 2017/0275866 | A1 * | 9/2017 | Hashimoto | E03D 9/08 |
| 2017/0275867 | A1 * | 9/2017 | Hashimoto | E03D 9/08 |
| 2018/0223518 | A1 * | 8/2018 | Tsuruta | E03D 9/08 |
| 2018/0223519 | A1 * | 8/2018 | Tsuruta | E03D 9/08 |
| 2020/0032498 | A1 * | 1/2020 | Ge | E03D 9/08 |
| 2020/0113170 | A1 * | 4/2020 | Davis | A01M 7/0089 |

* cited by examiner

*Primary Examiner* — Lori L Baker
(74) *Attorney, Agent, or Firm* — Foley Lardner LLP

(57) ABSTRACT

A nozzle assembly including a body having a top surface; a plurality of water inlets formed on the body and comprising first and second water inlets; a plurality of water outlets formed on the body and comprising first and second water outlets; and a solenoid valve. The first water inlet is in fluid communication with the first water outlet via a first water path, and the second water inlet is in fluid communication with the second water outlet via a second water path. The first water outlet and the second water outlet are concentrically arranged on the top surface, and the first water outlet and the second water outlet are configured to spray water in different patterns. The solenoid valve is configured to control an on and an off of a flow of water through each of the first water path and the second water path.

20 Claims, 5 Drawing Sheets

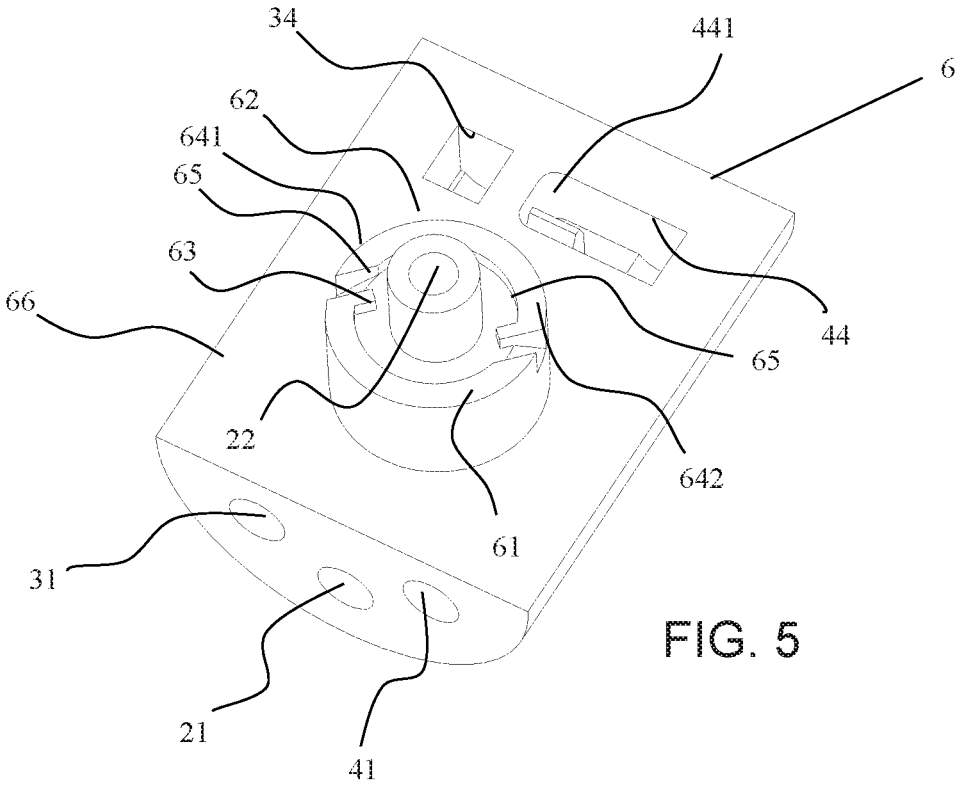
FIG. 5
FIG. 6
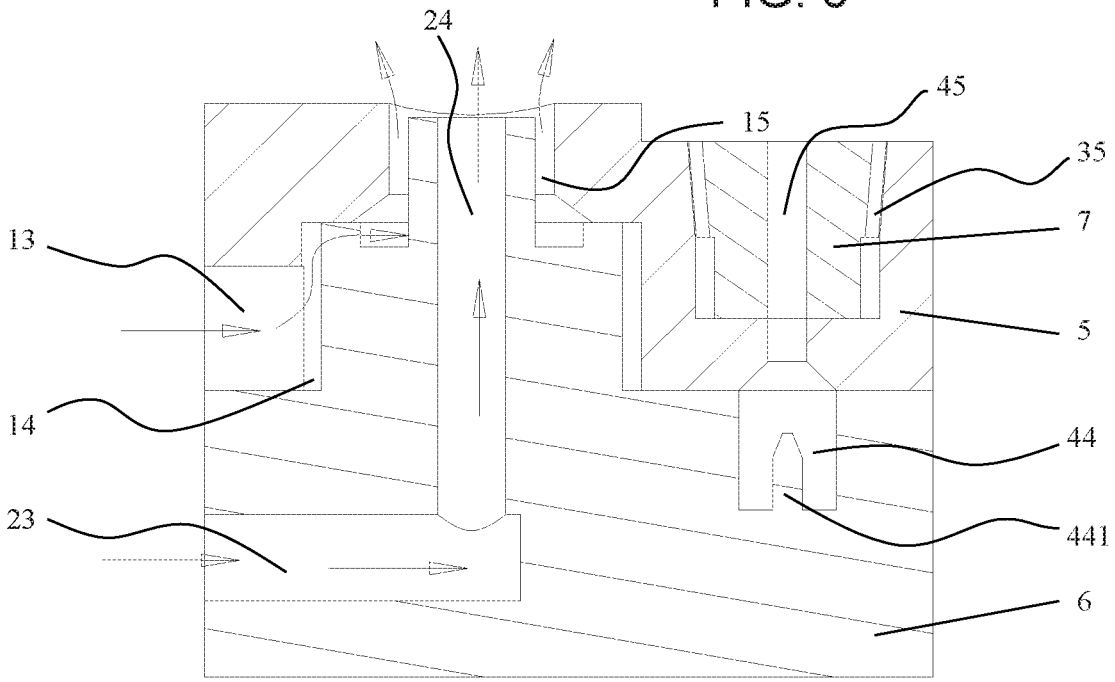

NOZZLE ASSEMBLY

CROSS-REFERENCE TO RELATED PATENT APPLICATIONS

This application claims priority to and the benefit of Chinese Priority Application No. 201810848333.8, filed Jul. 27, 2018, and Chinese Priority Application No. 201821219661.3, filed Jul. 27, 2018. The entire disclosures of each of the foregoing applications including the specification, drawings, claims and abstract, are incorporated herein by reference.

TECHNICAL FIELD

The present disclosure relates to the field of smart toilet technologies. More specifically, this application relates to a nozzle assembly for a smart toilet.

BACKGROUND

Currently, the main water spraying method of existing water spray apparatuses involves a single water jet hole that at most can provide two separate water patterns to a washing position. There are not many water patterns, which cannot meet the variety requirement for water spray patterns of water spray apparatuses.

Therefore, it is necessary to design a nozzle assembly capable of forming a variety of water patterns.

SUMMARY

The objective of the present invention is to overcome insufficiencies of the prior art by providing a nozzle assembly capable of forming a variety of water patterns.

A technical solution of the present application provides a nozzle assembly that includes a body having a top surface; a plurality of water inlets formed on the body and comprising a first water inlet and a second water inlet; a plurality of water outlets formed on the body and comprising a first water outlet and a second water outlet; and a solenoid valve. The first water inlet is in fluid communication with the first water outlet via a first water path, and the second water inlet is in fluid communication with the second water outlet via a second water path. The first water outlet and the second water outlet are concentrically arranged on the top surface, and the first water outlet and the second water outlet are configured to spray water in different patterns. The solenoid valve is configured to control an on and an off of a flow of water through each of the first water path and the second water path. That is, the solenoid valve selectively turns on and off the flow of water to the first and second water paths, such as independently from one another.

A technical solution of the present application provides a nozzle assembly having a body, and water inlets and water outlets formed on the body. The water inlets include a first water inlet and a second water inlet, and the water outlets include a first water outlet and a second water outlet. The first water inlet is in communication with the first water outlet via a first water path, and the second water inlet is in communication with the second water outlet via a second water path. The first water outlet and the second water outlet are arranged concentrically on a top surface of the body, and the first water outlet and the second water outlet can spray water in different patterns. The nozzle assembly further includes a solenoid valve, and the solenoid valve is configured to control turning the first water path and the second water path on and off.

According to at least one embodiment, the body includes a top cover and a bottom cover, where the first water outlet and the second water outlet are both arranged on a top surface of the top cover.

According to at least one embodiment, the first water outlet is annular, the second water outlet is round, and the second water outlet is at a center of an inner side of the first water outlet.

According to at least one embodiment, the first water inlet is formed on a bottom of a front end surface of the top cover, and a first hollow is formed in a middle of the top cover and extends from the first water inlet to a rear end surface; the top cover includes a round second hollow in communication with the first hollow, and the central axis of the second hollow extends upwardly from a bottom surface of the top cover in a vertical direction; the top cover includes a round third hollow that is in communication with the second hollow and is disposed above the second hollow, the third hollow is co-axial with the second hollow, a diameter of the third hollow is smaller than a diameter of the second hollow, and a top of the third hollow is connected to the first water outlet; a top surface of the bottom cover extends upwardly to form a first column and a second column, the second column is above the first column, and a diameter of the second column is smaller than a diameter of the first column; and the first hollow, the second hollow and the third hollow of the top cover form a first water path with the top surface, the first column and the second column of the bottom cover.

According to at least one embodiment, a recessed annular water channel is formed between the first column and the second column, at least one notch is formed on the first column, and the notch is in communication with the annular water channel.

According to at least one embodiment, the extending direction of the notch is parallel to or overlaps with a central tangent line of the annular water channel at a corresponding location.

According to at least one embodiment, the notch has a long side and a short side, the short side of the notch extends toward the second column and forms a guide plate, and the extending direction of the guide plate is parallel to the extending direction of the notch.

According to at least one embodiment, a longitudinal cross section of the notch is trumpet-shaped, and the trumpet-shaped notch narrows toward the inner side of the first water outlet.

According to at least one embodiment, the second water inlet is formed on the front end surface of the bottom cover, the second water path is formed in the bottom cover, the second water path includes second lateral water path and a second longitudinal water path, the front end of the second lateral water path is connected with the second water inlet, the rear end of the second lateral water path is connected with the bottom end of the second longitudinal water path, the second longitudinal water path extends along the central line of the second column, and the top end of the second longitudinal water path is in communication with the second water outlet disposed at the center of the second column.

According to at least one embodiment, the solenoid valve controls turning the first water path and the second water path on and off, and includes or is operable in four water discharge modes: a first water discharge mode in which only the first water outlet discharges water; a second water discharge mode in which only the second water outlet discharges water; a third water discharge mode in which the first water outlet and the second water outlet discharge water in an alternate pulse manner; and a fourth water discharge mode in which the first water outlet and the second water outlet discharge water simultaneously.

According to at least one embodiment, the water inlets includes a third water inlet and a fourth water inlet, and the water outlets includes a third water outlet and a fourth water outlet. The third water inlet is in communication with the third water outlet via a third water path, and the fourth water inlet is in communication with the fourth water outlet via a fourth water path. The third water outlet and the fourth water outlet are concentrically arranged on the top surface of the body, and the third water outlet and the fourth water outlet can spray water in different patterns. The solenoid valve is configured to control turning the third water outlet and the fourth water path on and off.

According to at least one embodiment, the third water outlet includes a plurality of semi-circular holes distributed along the same circle, the fourth water outlet is round, and the fourth water outlet is at the center of the inner side of the plurality of third water outlets.

According to at least one embodiment, the third water inlet is formed on the front end surface of the bottom cover, the third water path includes a third lateral water path, a third longitudinal water path, and a third radiating water path. The third lateral water path is connected to the third water inlet and is formed in the bottom cover. The third longitudinal water path is formed in the bottom cover and the top cover and is in communication with the third lateral water path and the third radiating water path. A round fourth hollow is formed in the top cover, and a cylindrical water nozzle is installed in the fourth hollow. A plurality of curved grooves are formed in the longitudinal direction on the circumferential surface of the water nozzle, a plurality of the third radiating water paths are formed between the curved grooves and the fourth hollow, and the top ends of the third radiating water paths are connected to the third water outlet.

According to at least one embodiment, the fourth water inlet is formed on the front end surface of the bottom cover, the fourth water path includes a fourth lateral water path, a fourth bending water path, and a fourth longitudinal water path. The fourth lateral water path is connected to the fourth water inlet and is formed in the bottom cover. The fourth bending water path is formed in the bottom cover for connecting the fourth lateral water path and the fourth longitudinal water path. The fourth longitudinal water path is formed in the top cover and the water nozzle and is connected to the fourth water outlet, and the fourth water outlet is formed at the center of the water nozzle.

According to at least one embodiment, the bottom of the fourth bending water path is provided with a protrusion extending upwardly.

The above-described technical solution achieves advantageous effects. For example, the present invention can achieve, among other things, a water discharge effect having different water patterns by concentrically arranging two water outlets that spray water in different patterns and by controlling respective water paths through a solenoid valve.

BRIEF DESCRIPTION OF THE DRAWINGS

The disclosure will become more fully understood from the following detailed description, taken in conjunction with the accompanying figures, wherein like reference numerals refer to like elements.

FIG. 5 is another perspective view of the bottom cover of the nozzle assembly.

FIG. 6 is a cross-sectional view taken along line 6-6 in FIG. 1.

DETAILED DESCRIPTION

Before turning to the figures, which illustrate one or more exemplary embodiments in detail, it should be understood that the present disclosure is not limited to the details or methodology set forth in the description or illustrated in the figures. It should also be understood that the terminology used herein is for the purpose of description only and should not be regarded as limiting.

The specific implementation manner of the present invention will be further described below with reference to the accompanying drawings.

A variety of interchangeable structural manners and implementation manners should be easy to understand by a person skilled in the art, according to the technical solution of the present invention and without departing from the essence and spirit of the present invention. Therefore, the following disclosure and accompanying drawings are merely an exemplary of the technical solution of the present invention, and should not be construed as all of the present invention or limitations or restrictions to the technical solution of the present invention.

Figure 1:
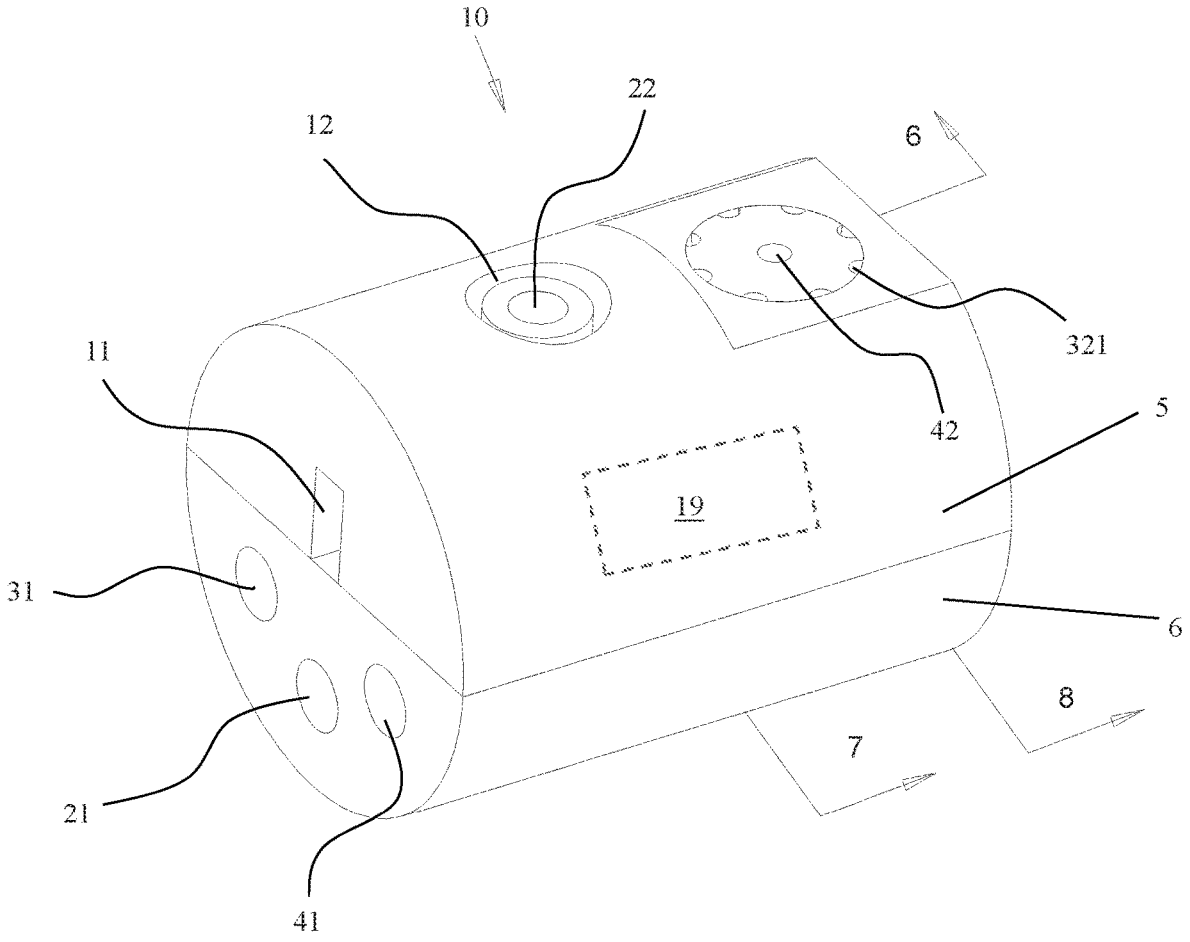
FIG. 1 is a perspective view of a nozzle assembly, according to one embodiment of the present application.
Figure 2:
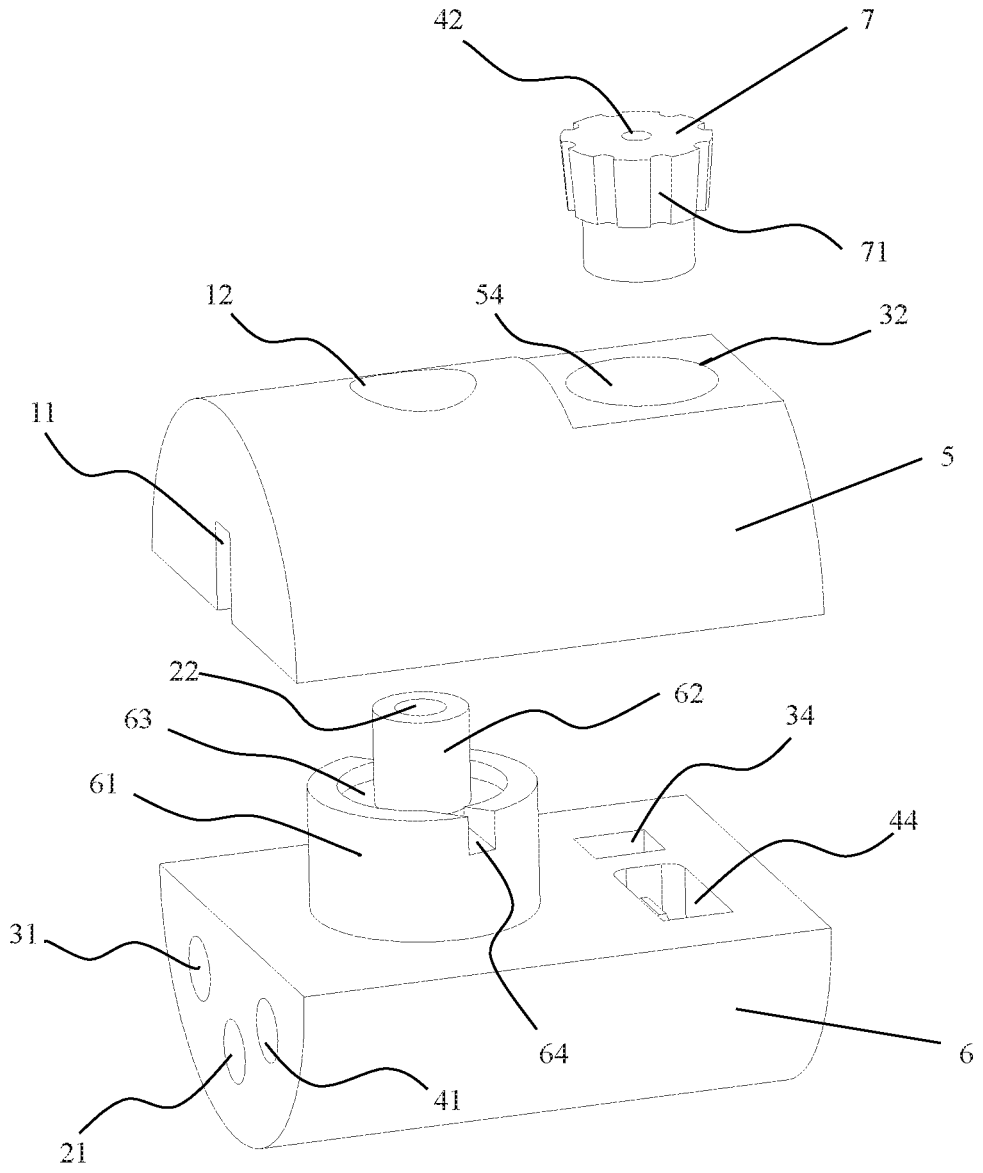
FIG. 2 is an exploded view of the nozzle assembly shown in FIG. 1.

FIGS. 1 and 2 illustrate an exemplary embodiment of a nozzle assembly that includes a body 10. Formed in the body 10 are one or more water inlets and one or more water outlets. As shown, the body 10 includes each of a first water inlet 11, a second water inlet 21, a first water outlet 12 and a second water outlet 22. The first water inlet 11 is in communication (e.g., fluid communication, fluidly connected, etc.) with the first water outlet 12 via a first water path, and the second water inlet 21 is in communication with the second water outlet 22 via a second water path. As shown in FIG. 1, the first water outlet 12 and the second water outlet 22 are concentric (i.e., concentrically arranged) on a top surface of the body 10, with the first water outlet 12 surrounding a wall defining the second water outlet 22. The first water outlet 12 and the second water outlet 22 can spray water in different patterns.

The nozzle assembly also includes a solenoid valve 19 that controls a flow to the first and second water paths. That is, the solenoid can selectively turn on and off a flow to each of the first water path and the second water path.

Also shown in FIG. 1, a center (e.g., centerline, central axis, etc.) of the first water outlet 12 overlaps with a center of the second water outlet 22, both of which are located on the top surface of the body 10. As controlled by the solenoid valve 19, the first water outlet 12 can discharge water alone, such as in a first position, the second water outlet 22 can discharge water alone, such as in a second position, or the first water outlet 12 and the second water outlet 22 can discharge water simultaneously, such as in a third position. Since the center of the first water outlet 12 overlaps with the center of the second water outlet 22, a new water pattern can be produced when the first water outlet 12 and the second water outlet 22 having different water patterns discharge water simultaneously.

Compared with the existing modes that only have individual water discharge and no variety, a variety of different water patterns are achievable (or producible) through various combinations of water discharge by the first water outlet 12 and the second water outlet 22 in the present embodiment.

More specifically, as shown in FIGS. 1 and 2, the body 10 comprises a top cover 5 and a bottom cover 6. The illustrated body 10 is cylindrical, and each of the top cover 5 and the bottom cover 6 are semi-cylindrical. Each of the first water outlet 12 and the second water outlet 22 is arranged on or in (e.g., extending through) the top surface of the top cover 5. The first water outlet 12 is annular, the second water outlet 22 is round/circular, and the second water outlet 22 is at the center of the inner side of the first water outlet 12. Optionally, the body 10, the top cover 5 and the bottom cover 6 are not limited to be cylindrical and semi-cylindrical shapes, but may also be of other shapes (e.g., cuboidal).

The nozzle assembly is connectable with a water spray tube of a smart toilet. When the body cleaning function (for a user of the toilet) needs to be performed or used, the water spray tube extends out, and the water spray tube extends the nozzle assembly out. The first water outlet 12 and/or the second water outlet 22 spray out a water stream to clean a portion of the body of the user of the smart toilet.

The first water path will now be described.

Figure 3:
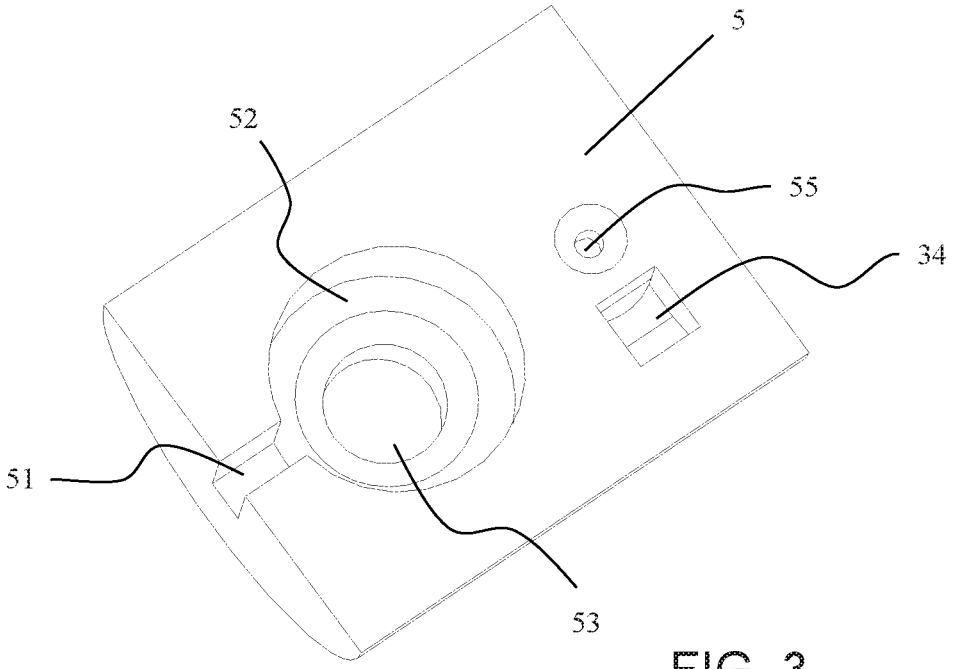
FIG. 3 is a perspective view of a top cover of the nozzle assembly, according to an exemplary embodiment of the present application.

As shown in FIG. 2, the first water inlet 11 is formed on a bottom of the front end surface of the top cover 5. As shown in FIG. 3, a first hollow 51 is formed in a portion (e.g., a middle part) of the top cover 5 and extends from the first water inlet 11 to a rear end surface. Herein, the term "front" refers to the left side of FIGS. 1 and 2 and the "front end surface" refers to the end surface of the left side of the top cover 5 in FIGS. 1 and 2.

The top cover 5 includes a second hollow 52, which has a circular shape and is in communication with the first hollow 51. A central axis of the second hollow 52 extends upwardly from a bottom surface of the top cover 5 in a vertical direction. The illustrated top cover 5 includes a round third hollow 53, which is disposed above and in communication with the second hollow 52. As shown, the third hollow 53 is co-axial with the second hollow 52, a diameter of the third hollow 53 is smaller than a diameter of the second hollow 52, and a top (portion) of the third hollow 53 is connected to the first water outlet 12.

Figure 4:
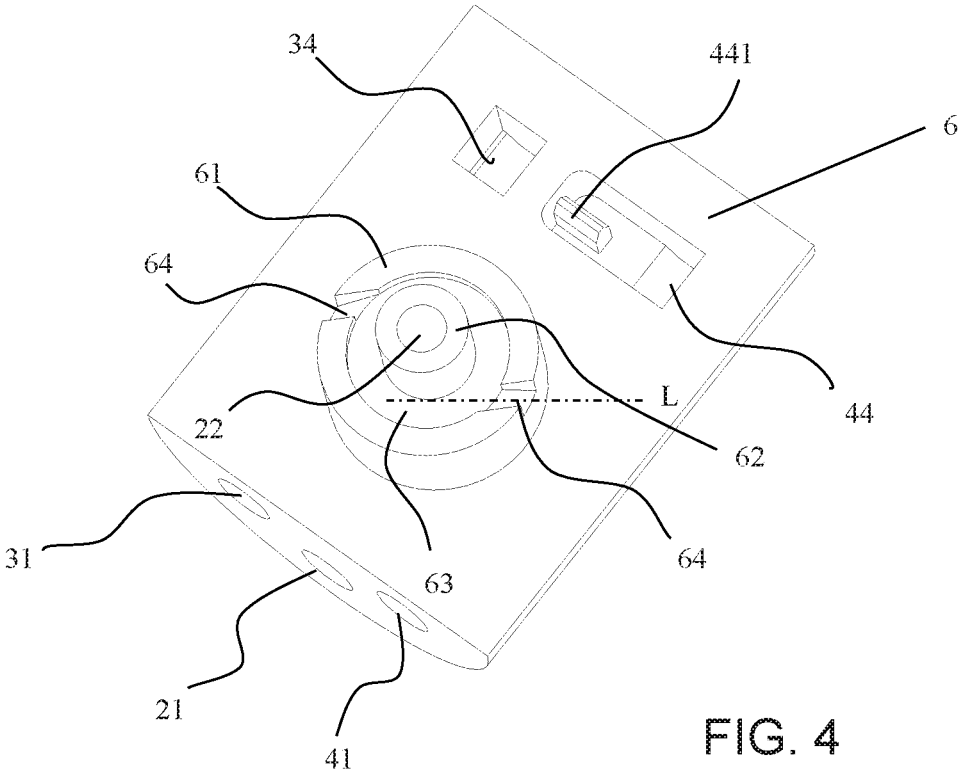
FIG. 4 is a perspective view of a bottom cover of the nozzle assembly, according to an exemplary embodiment of the present application.

The bottom cover 6 includes a top surface that extends upwardly to form a first column 61 and a second column 62. As shown in FIGS. 2 and 4, the second column 62 extends above the first column 61, and a diameter of the second column 62 is smaller than a diameter of the first column 61. The first hollow 51, the second hollow 52, and the third hollow 53 of the top cover 5 form the first water path with a top surface 66 (FIG. 5), the first column 61 and the second column 62 of the bottom cover 6. Thus, the top cover 5 and the bottom cover 6 define the first water path together after the top cover 5 and the bottom cover 6 are coupled/assembled.

FIG. 6 illustrates a first lateral water path 13, which is formed between the first hollow 51 and the top surface 66 of the bottom cover 6. Also shown, a first big annular water path 14 is formed between the second hollow 52 and the first column 61; and a first small annular water path 15 is formed between the third hollow 53 and the second column 62. The arrows (in the flow path) in FIG. 6 indicate water flow directions. In the first water path, water flows from the first water inlet 11 to the first lateral water path 13, then to the first big annular water path 14, then to the first small annular water path 15, and then to the first water outlet 12.

Figure 7:
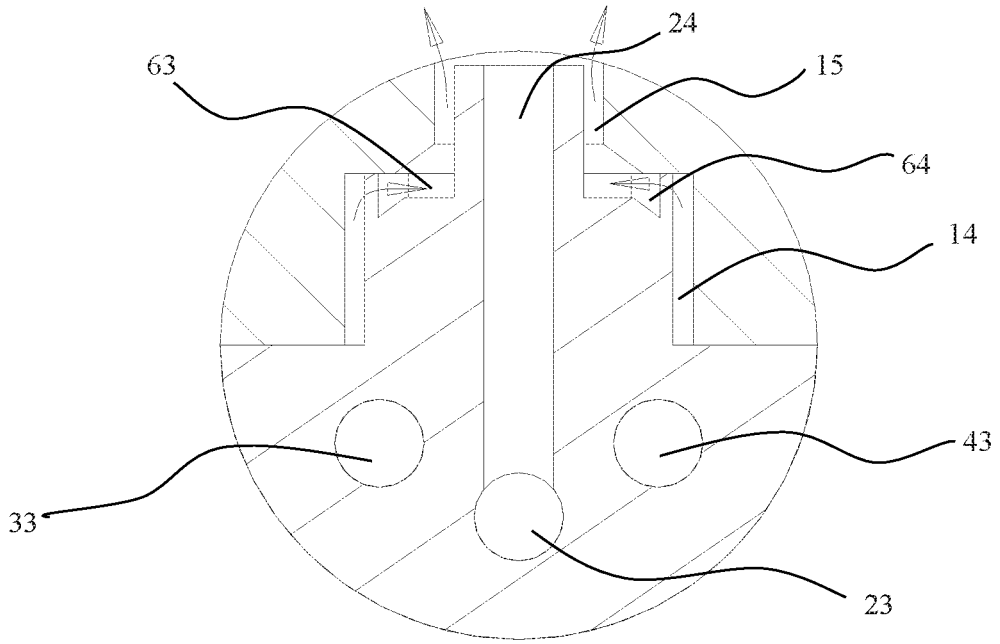
FIG. 7 is a cross-sectional view taken along line 7-7 in FIG. 1.

Furthermore, as shown in FIGS. 4 and 7, a recessed annular water channel 63 is formed between the first column 61 and the second column 62, at least two notches 64 are formed on the first column 61, and the notches 64 are in communication with the annular water channel 63. Water flows from the first big annular water path 14 into the notches 64, then into the annular water channel 63, then into the first small annular water path 15 from the annular water channel 63, and eventually flows out from the annular first water outlet 12.

Since two water streams enter the annular water channel 63 alternately and in opposite directions (e.g., toward each other) along the two notches 64, and rotate circumferentially along the sidewall of the annular water channel 63, water is sprayed along the external wall of the second column 62 along with the flow to form an inverted cone-shaped misty water pattern. Notably, the extending direction of the notches 64 overlaps with or is parallel to a central tangent line of the annular water channel 63 at a corresponding location.

As shown in FIG. 4, the extending line L of the notch 64 is parallel to a central tangent line of the annular water channel 63 at this location. In this way, the extending line L of the notch 64 can be parallel to and close to overlapping with an orthographic (e.g., orthogonal) projection of the central tangent line of the first water outlet 12 in the vertical direction. This causes water to flow along the circumferential wall as much as possible, thereby providing the incoming water with the maximum centrifugal force and making the outgoing water to be of a rotating water pattern.

Optionally, as shown in FIG. 5, the notch 64 has a long side 641 and a short side 642. Unlike the above embodiment, the short side 642 of the notch 64 extends toward the second column 62 and forms a guide plate 65, and the extending direction of the guide plate 65 is parallel to the extending direction of the notch 64. The guide plate 65 is at a distance from the external wall of the second column 62, such that water can flow through. The height of the guide plate 65 can be slightly lower than that of the notch 64. The guide plate 65 guides water flow, such that water flows through the two notches 64 are alternate and in opposite directions toward each other, thereby forming two water flows that do not disturb each other.

As shown in FIG. 7, the longitudinal cross section of the notch 64 has a trumpet-shape, and the trumpet-shaped notch 64 narrows toward the inner side of the first water outlet 12. The trumpet-shaped notch 64 facilitates the water flow to enter the annular water channel 63 and reduces resistance. Optionally, the top and bottom edges of the longitudinal cross section of the notch 64 may also be parallel to each other.

The second water path will now be described.

As shown in FIGS. 2 and 6, the second water inlet 21 is formed on the front end surface of the bottom cover 6 and opens into a second lateral water path 23. The second water path is formed in the bottom cover 6 and includes the second lateral water path 23 and a second longitudinal water path 24. A front or leading end of the second lateral water path 23 is connected with the second water inlet 21, and a rear or trailing end of the second lateral water path 23 is connected with a bottom end of the second longitudinal water path 24. The second longitudinal water path 24 extends along the central line of the second column 62, and the top end of the second longitudinal water path 24 is in communication with the second water outlet 22 disposed at the center of the second column 62. In the second water path, water flows from the second water inlet 21 to the second lateral water path 23 to the second longitudinal water path 24 and to the second water outlet 22.

In the illustrated embodiment, the solenoid valve 19 controls selectively turning on and off of the first water path and the second water path. The nozzle assembly is operable in four water discharge modes including a first water discharge mode, in which only the first water outlet 12 discharges water. In at least one embodiment, the water pattern is an inverted cone-shaped misty water pattern. In the illustrated embodiment, the longitudinal cross section of the notch 64 is set to be trumpet shaped, such that the extending line L of the notch 64 is parallel to or overlaps with a central tangent line of the annular water channel 63 at the corresponding location. The guide plate 65 if provided, both of which (e.g., notches, channels, etc.) are for forming an inverted cone-shaped misty water pattern at the first water outlet 12, i.e., a water column sprayed spirally upwardly. In a second water discharge mode, only the second water outlet 22 discharges water and the water pattern is a straight sprayed column. In a third water discharge mode, both the first water outlet 12 and the second water outlet 22 discharge water in an alternate pulse manner. In a fourth water discharge mode, both the first water outlet 12 and the second water outlet 22 discharge water simultaneously and the water pattern is a combination of an inverted cone-shaped misty water pattern on the outside and a straight sprayed water column in the middle. Notably, the nozzle assemblies disclosed herein can include any combination of the four discharge modes, as well as additional discharge modes.

One or more embodiments further includes another set of water discharge combination, i.e., the combination of the third water outlet/path and/or the fourth water outlet/path. The water outlets of the third water outlet/path and the fourth water outlet/path are spaced by certain distance from the water outlets of the first water outlet/path and the second water outlet/path, such as to clean different parts of a person's body using the smart toilet.

The nozzle assembly (e.g., the body 10) can include additional water inlets and/or water outlets. As shown in FIGS. 1-2, the nozzle assembly (e.g., water inlets thereof) includes a third water inlet 31 and a fourth water inlet 41, and the nozzle assembly (e.g., water outlets thereof) includes a third water outlet 32 and a fourth water outlet 42. The third water inlet 31 is in communication (e.g., fluid communication) with the third water outlet 32 via a third water path, and the fourth water inlet 41 is in communication with the fourth water outlet 42 via a fourth water path. The illustrated third water outlet 32 and the fourth water outlet 42 are concentrically arranged on a top surface of the body 10, and the third water outlet 32 and the fourth water outlet 42 can spray water in different patterns. The solenoid valve 19 is configured to control turning of the third water outlet and the fourth water path on and off.

The illustrated third water outlet 32 includes eight semi-circular holes 321, where the eight semi-circular holes 321 are spaced apart and distributed evenly along the same circle (e.g., a radius) and with respect to the same center of the circle. The third water outlet 32 and the fourth water outlet 42 being concentrically arranged on the top surface of the body refers to that the center of the circle surrounded by the plurality of the semi-circular holes 321 overlaps with the center of the circle of the fourth water outlet 42.

Third water path will now be described.

As shown in FIGS. 1-2, the third water outlet 32 includes a plurality of semi-circular holes 321 (e.g., eight holes) distributed along the same circle, the fourth water outlet 42 is round, and the fourth water outlet 42 is at the center of the inner side of the plurality of third water outlets 32.

As shown in FIGS. 2-3 and FIGS. 7-8, the third water inlet 31 is formed on the front end surface of the bottom cover 6; and the third water path includes a third lateral water path 33, a third longitudinal water path 34, and a third radiating water path 35. The third lateral water path 33 is connected to the third water inlet 31 and is formed in the bottom cover 6. The third longitudinal water path 34 is formed in the bottom cover 6 and the top cover 5 is in communication with the third lateral water path 33 and the third radiating water path 35. A round fourth hollow 54 is formed in the top cover 5; and a cylindrical water nozzle 7 is installed in the fourth hollow 54. A plurality of curved grooves 71 are formed in the longitudinal direction on the circumferential surface of the water nozzle 7; and a plurality of the third radiating water paths 35 are formed between the curved grooves 71 and the fourth hollow 54. Top ends of the third radiating water paths 35 are connected to the third water outlet 32.

Figure 8:
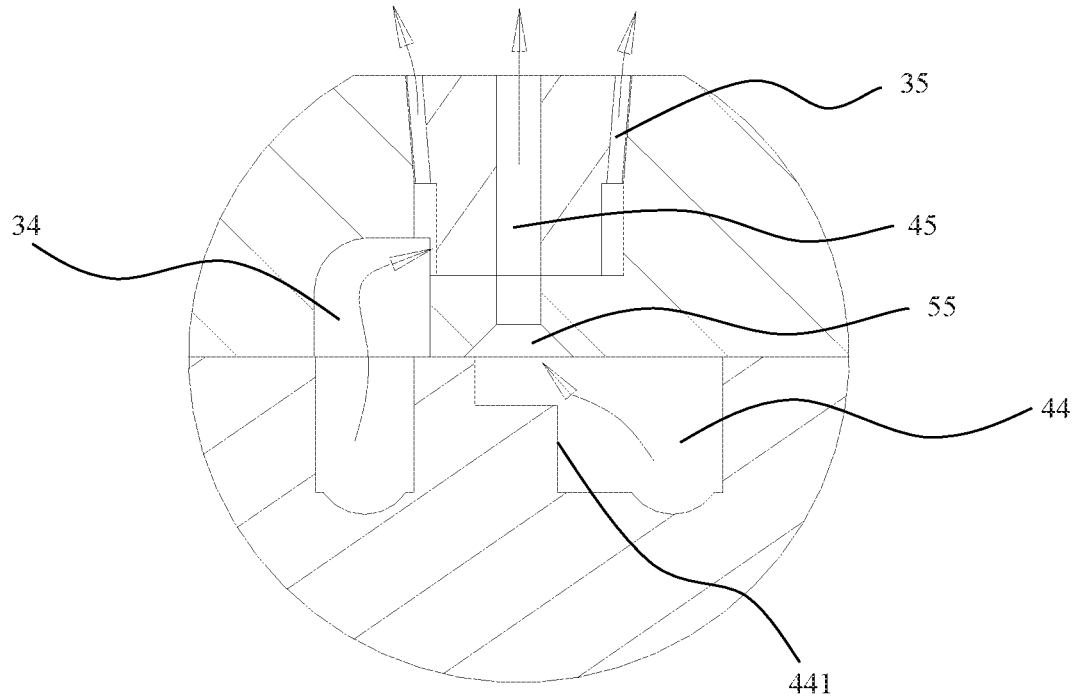
FIG. 8 is a cross-sectional view taken along line 8-8 in FIG. 1.

The hollow arrows in FIG. 8 indicate water flow directions. In the third water path, water flows from the third water inlet 31 to the third lateral water path 33 to the third longitudinal water path 34 to the third radiating water paths 35 and to the third water outlet 32. Further, the water nozzle 7 has a plurality (e.g., eight) curved grooves 71 thereon. The curved grooves 71 and the inner wall of the fourth hollow 54 jointly form a plurality of (e.g., eight) third radiating water paths 35. The third radiating water paths 35 surround the same center of the circle, tilt from bottom up and from inside out, and spray an inverted cone-shaped water pattern. The water nozzle 7 is a part of the body (e.g., upon assembly) in the illustrated embodiment.

The fourth water path will now be described.

As shown in FIG. 2 and FIGS. 6-8, the fourth water inlet 41 is formed on the front end surface of the bottom cover 6; and the fourth water path includes a fourth lateral water path 43, a fourth bending water path 44, and a fourth longitudinal water path 45. The fourth lateral water path 43 is connected to the fourth water inlet 41 and is formed in the bottom cover 6. The fourth bending water path 44 is formed in the bottom cover 6 for connecting the fourth lateral water path 43 and the fourth longitudinal water path 45. The fourth longitudinal water path 45 is formed in the top cover 5 and the water nozzle 7 and is connected to the fourth water outlet 42. The fourth water outlet 42 is formed at the center of the water nozzle 7.

The fourth bending water path 44 is also arranged laterally or on a horizontal plane, but is perpendicular to the fourth lateral water path 43. In the fourth water path, water flows from the fourth water inlet 41 to the fourth lateral water path 43 to the fourth bending water path 44 to the fourth longitudinal water path 45 and to the fourth water outlet 42. The water pattern sprayed from the fourth water outlet 42 is also is a straight sprayed column.

As shown in FIG. 3 and FIG. 8, an inverted funnel portion 55 is provided underneath the fourth hollow 54 of the top cover 5, and the fourth longitudinal water path 45 and the fourth bending water path 44 are connected via the inverted funnel portion 55. As shown in FIG. 6 and FIG. 8, the bottom of the fourth bending water path 44 is provided with a protrusion 441 extending upwardly. The protrusion 441 is configured to disrupt the centrifugal force of water, such that the sprayed water column is more concentrated and vertical.

The solenoid valve controls the on and off (function) of the third water path and the fourth water path. That is the solenoid can turn the third and fourth water paths on and off (e.g., independently of the other). The third and/or fourth water paths may include four water discharge modes. In a first water discharge mode, only the third water outlet 32 discharges water, and the water pattern is an inverted cone-shaped water pattern. In a second water discharge mode, only the fourth water outlet 42 discharges water, and the water pattern is a straight sprayed column. In a third water discharge mode, the third water outlet 32 and the fourth water outlet 42 discharge water in an alternate pulse manner. In a fourth water discharge mode, the third water outlet 32 and the fourth water outlet 42 discharge water simultaneously, and the water pattern is a circle surrounded by 8 small water columns sprayed upwardly in an inclined way with a shape similar to an inverted cone, plus a water column in the middle.

The present invention solves, as a main problem, that a single water outlet provides a single washing water pattern to a cleaning part. By combining two water patterns produced by two water outlets in concentric locations, a variety of different water patterns can be produced to wash a part, which provides different washing effects, in particular a combination of an inverted cone-shaped misty water pattern and a straight sprayed column water pattern. Notably, the shapes of water outlets or discharged water patterns in the present invention are not limited to the types disclosed in the specific embodiments, but can also be any combination of other different water patterns.

The above described are only the principle and preferred embodiments of the present invention. It should be noted that a person of ordinary skills in the art may make other variations based on the principle of the present invention, which shall also fall within the protection scope of the present invention.

As utilized herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the disclosure as recited in the appended claims.

It should be noted that the term "exemplary" and variations thereof, as used herein to describe various embodiments, are intended to indicate that such embodiments are possible examples, representations, or illustrations of possible embodiments (and such terms are not intended to connote that such embodiments are necessarily extraordinary or superlative examples).

The term "coupled" and variations thereof, as used herein, means the joining of two members directly or indirectly to one another. Such joining may be stationary (e.g., permanent or fixed) or moveable (e.g., removable or releasable). Such joining may be achieved with the two members coupled directly to each other, with the two members coupled to each other using a separate intervening member and any additional intermediate members coupled with one another, or with the two members coupled to each other using an intervening member that is integrally formed as a single unitary body with one of the two members. If "coupled" or variations thereof are modified by an additional term (e.g., directly coupled), the generic definition of "coupled" provided above is modified by the plain language meaning of the additional term (e.g., "directly coupled" means the joining of two members without any separate intervening member), resulting in a narrower definition than the generic definition of "coupled" provided above. Such coupling may be mechanical, electrical, or fluidic.

The term "or," as used herein, is used in its inclusive sense (and not in its exclusive sense) so that when used to connect a list of elements, the term "or" means one, some, or all of the elements in the list. Conjunctive language such as the phrase "at least one of X, Y, and Z," unless specifically stated otherwise, is understood to convey that an element may be either X, Y, Z; X and Y; X and Z; Y and Z; or X, Y, and Z (i.e., any combination of X, Y, and Z). Thus, such conjunctive language is not generally intended to imply that certain embodiments require at least one of X, at least one of Y, and at least one of Z to each be present, unless otherwise indicated.

References herein to the positions of elements (e.g., "top," "bottom," "above," "below") are merely used to describe the orientation of various elements in the FIGURES. It should be noted that the orientation of various elements may differ according to other exemplary embodiments, and that such variations are intended to be encompassed by the present disclosure.

Positional terms that are used or may be used in the present specification, such as upper, lower, left, right, forward, backward, front, back, top, bottom, and the like, are defined with respect to the structures shown in the figures and are relative concepts. Therefore, corresponding changes may occur depending on different locations and different states of use thereof. As a result, these or other positional terms shall not be construed as limiting terms.

Although the figures and description may illustrate a specific order of method steps, the order of such steps may differ from what is depicted and described, unless specified differently above. Also, two or more steps may be performed concurrently or with partial concurrence, unless specified differently above. Such variation may depend, for example, on the software and hardware systems chosen and on designer choice. All such variations are within the scope of the disclosure. Likewise, software implementations of the described methods could be accomplished with standard programming techniques with rule-based logic and other logic to accomplish the various connection steps, processing steps, comparison steps, and decision steps.

It is important to note that the construction and arrangement of the nozzle assemblies, as shown in the various exemplary embodiments is illustrative only. Additionally, any element disclosed in one embodiment may be incorporated or utilized with any other embodiment disclosed herein. Although only one example of an element from one embodiment that can be incorporated or utilized in another embodiment has been described above, it should be appreciated that other elements of the various embodiments may be incorporated or utilized with any of the other embodiments disclosed herein.

What is claimed is:

1. A nozzle assembly, comprising a body having a top surface;

a plurality of water inlets formed on the body and comprising a first water inlet and a second water inlet;

a plurality of water outlets formed on the body and comprising a first water outlet and a second water outlet; and a solenoid valve;

wherein the first water inlet is in fluid communication with the first water outlet via a first water path, and the second water inlet is in fluid communication with the second water outlet via a second water path, wherein the first water outlet and the second water outlet are concentrically arranged on the top surface, and the first water outlet and the second water outlet are configured to spray water in different patterns, and wherein the solenoid valve is configured to control an on and an off of a flow of water through each of the first water path and the second water path.

2. The nozzle assembly according to claim 1, wherein the body comprises a top cover and a bottom cover, the top surface is part of the top cover, and the first water outlet and the second water outlet are both arranged on the top surface of the top cover.

3. The nozzle assembly according to claim 2, wherein the first water outlet is annular, the second water outlet is round, and the second water outlet is at a center of an inner side of the first water outlet.

4. The nozzle assembly according to claim 3, wherein the first water inlet is formed on a bottom of a front end surface of the top cover, and a first hollow is formed in a middle of the top cover and extends from the first water inlet to a rear end surface.

5. The nozzle assembly according to claim 4, wherein the top cover comprises:

a round second hollow in fluid communication with the first hollow, wherein a central axis of the second hollow extends upwardly from the bottom surface of the top cover in a vertical direction; and a round third hollow in fluid communication with the second hollow and disposed above the second hollow, wherein the third hollow is co-axial with the second hollow, a diameter of the third hollow is smaller than a diameter of the second hollow, and a top of the third hollow is connected to the first water outlet.

6. The nozzle assembly according to claim 5, wherein a top surface of the bottom cover extends upwardly to form a first column and a second column, the second column is above the first column, and a diameter of the second column is smaller than a diameter of the first column.

7. The nozzle assembly according to claim 6, the first hollow, the second hollow, and the third hollow of the top define the first water path with the top surface, the first column and the second column of the bottom cover.

8. The nozzle assembly according to claim 7, wherein a recessed annular water channel is formed between the first column and the second column, at least one notch is formed on the first column, and the notch is in fluid communication with the annular water channel.

9. The nozzle assembly according to claim 8, wherein an extending direction of the notch is parallel to or overlaps with a central tangent line of the annular water channel at a corresponding location.

10. The nozzle assembly according to claim 9, wherein the notch has a long side and a short side, which extends toward the second column and forms a guide plate, and wherein an extending direction of the guide plate is parallel to the extending direction of the notch.

11. The nozzle assembly according to claim 8, wherein a longitudinal cross section of the notch has a trumpet shape, and the trumpet shape notch narrows toward the inner side of the first water outlet.

12. The nozzle assembly according to claim 7, wherein the second water inlet is formed on a front end surface of the bottom cover, the second water path is formed in the bottom cover, the second water path comprises a second lateral water path and a second longitudinal water path, a front end of the second lateral water path is connected with the second water inlet, a rear end of the second lateral water path is connected with a bottom end of the second longitudinal water path, the second longitudinal water path extends along a central line of the second column, and a top end of the second longitudinal water path is in fluid communication with the second water outlet disposed at a center of the second column.

13. The nozzle assembly according to claim 1, further comprising:

a first water discharge mode in which only the first water outlet discharges water;

a second water discharge mode in which only the second water outlet discharges water;

a third water discharge mode in which the first water outlet and the second water outlet discharge water in an alternate pulse manner; and a fourth water discharge mode in which the first water outlet and the second water outlet discharge water simultaneously.

14. The nozzle assembly according to claim 2, wherein the water inlets comprise a third water inlet and a fourth water inlet, the water outlets comprise a third water outlet and a fourth water outlet, the third water inlet is in fluid communication with the third water outlet via a third water path, and the fourth water inlet is in fluid communication with the fourth water outlet via a fourth water path.

15. The nozzle assembly according to claim 14, wherein the third water outlet and the fourth water outlet are concentrically arranged on the top surface of the body, the third water outlet and the fourth water outlet can spray water in different patterns, and the solenoid valve is configured to control an on and an off of a flow of water to each of the third water outlet and the fourth water path.

16. The nozzle assembly according to claim 15, wherein the third water outlet comprises a plurality of semi-circular holes distributed along the same circle, the fourth water outlet is round, and the fourth water outlet is at a center of an inner side of the plurality of third water outlets.

17. The nozzle assembly according to claim 16, wherein the third water inlet is formed on the front end surface of the bottom cover, and the third water path comprises a third lateral water path, a third longitudinal water path, and a third radiating water path.

18. The nozzle assembly according to claim 17, wherein the third lateral water path is connected to the third water inlet and is formed in the bottom cover, the third longitudinal water path is formed in the bottom cover and the top cover and is in fluid communication with the third lateral water path and the third radiating water path, a round fourth hollow is formed in the top cover, a cylindrical water nozzle is installed in the fourth hollow, a plurality of curved grooves are formed in the longitudinal direction on a circumferential surface of the water nozzle, a plurality of the third radiating water paths are formed between the curved grooves and the fourth hollow, and top ends of the third radiating water paths are connected to the third water outlet.

19. The nozzle assembly according to claim 18, wherein the fourth water inlet is formed on the front end surface of the bottom cover, the fourth water path comprises a fourth lateral water path, a fourth bending water path, and a fourth longitudinal water path, the fourth lateral water path is connected to the fourth water inlet and is formed in the bottom cover, the fourth bending water path is formed in the bottom cover for connecting the fourth lateral water path and the fourth longitudinal water path, the fourth longitudinal water path is formed in the top cover and the water nozzle and is connected to the fourth water outlet, and the fourth water outlet is formed at a center of the water nozzle.

20. The nozzle assembly according to claim 19, wherein a bottom of the fourth bending water path is provided with a protrusion extending upwardly.

* * * * *